United States Patent [19]

McKenry et al.

[11] 4,005,906

[45] Feb. 1, 1977

[54] IMPACT OR DEMOLITION TOOL

[75] Inventors: Robert J. McKenry, Windber; Michael A. College, Everett, both of Pa.

[73] Assignee: Kennametal Inc., Latrobe, Pa.

[22] Filed: Dec. 15, 1975

[21] Appl. No.: 640,686

[52] U.S. Cl. ..... 299/91; 175/410

[51] Int. Cl.[2] ..... E21C 13/00

[58] Field of Search ..... 299/91, 94; 175/409, 175/410, 411, 379; 30/168; 125/41

[56] References Cited

UNITED STATES PATENTS

| | | | |
|---|---|---|---|
| 3,522,852 | 8/1970 | Bardwell | 175/410 X |
| 3,583,504 | 6/1971 | Aalund | 175/410 X |
| 3,807,804 | 4/1974 | Kniff | 299/91 |
| 3,841,709 | 10/1974 | Kniff | 299/91 X |
| 3,858,671 | 1/1975 | Kita et al. | 175/410 |
| 3,885,638 | 5/1975 | Skidmore | 175/410 |
| 3,915,246 | 10/1975 | Sheshtawy | 175/410 X |

*Primary Examiner*—Ernest R. Purser
*Assistant Examiner*—Richard E. Favreau
*Attorney, Agent, or Firm*—Lawrence R. Burns

[57] ABSTRACT

An impact or demolition tool consisting of a rod-like steel holder with one end adapted for being gripped by an impact tool while the other end has inserts of hard wear resistant material, such as a cemented hard metal carbide, imbedded therein in distributed relation.

5 Claims, 6 Drawing Figures

IMPACT OR DEMOLITION TOOL

The present invention relates to an impact or demolition tool, especially adapted for being impacted against hard formations, such as rocks or concrete, which are to be broken up.

Such tools are mounted in a driver, such as a jack hammer or the like, and are impacted against the material to be broken up. A tool of the general nature referred to is illustrated in U.S. Pat. No. 3,807,804, assigned to the same assignee as the present application.

In the tool of the above-identified patent, a heavy, massive piece of carbide is mounted in the working end of the holder and is the element which directly impacts the formation to be broken up. While such a tool is highly efficient in respect of breaking up hard formations, it is the case that such tools, especially when mounted in manually operable jack hammers, are sometimes used for prying the formation open once it has been cracked.

When the tool is employed as a pry bar, a single massive piece of carbide in the tip can be fractured because cemented carbide material is weak in tension and is not well adapted for withstanding bending forces as would be exerted thereon during a prying operation.

With the foregoing in mind, the present invention proposes the provision of an impact tool of the nature referred to which avoids the drawbacks referred to above by providing the working end of the tool with small hard wear resistant impact elements imbedded therein in distributed relation.

Another object is the provision of an impact tool of the nature referred to which will not be broken when employed as a prying tool.

BRIEF SUMMARY OF THE INVENTION

According to the present invention, a steel rod of substantial size is provided which, at one end, is adapted for being gripped in an impact motor or jack hammer for being impelled axially against a hard formation which is to be reduced or broken up.

According to the present invention, a plurality of hard wear resistant elements, such as cemented hard metal carbide elements, are mounted in the working end of the steel rod in distributed relation with the outer ends of the elements positioned for engagement with the formation to be broken. The working end of the rod includes at least one wear resistant element facing axially outwardly for engagement with the formation to be broken up.

The hard wear resistant elements can be press fitted into the rod, or holder, or may be brazed therein.

The exact nature of the present invention will become more clearly apparent upon reference to the following detailed specification taken in connection with the accompanying drawings in which.

DETAILED DESCRIPTION OF THE INVENTION

Figure 1:
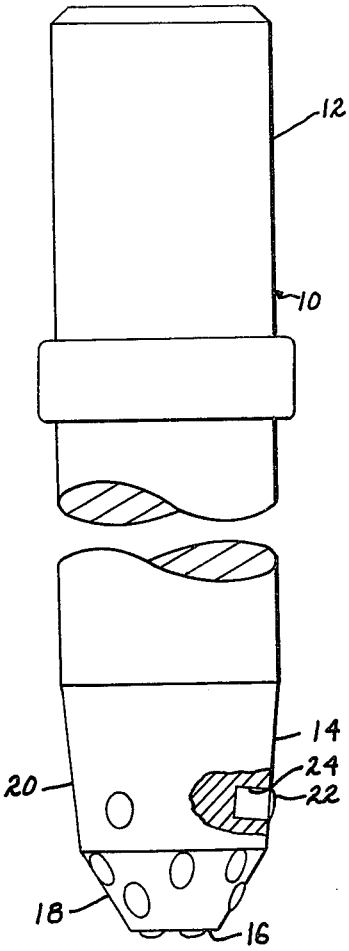
FIG. 1 is a side view partly broken away showing a steel holder according to the present invention having wear resistant elements distributed in the working end thereof.
Figure 2:
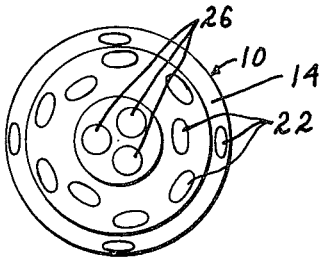
FIG. 2 is a bottom plan view of the tool of FIG. 1.

Referring to the drawings somewhat more in detail, and with particular reference to FIGS. 1 and 2, the tool comprises a steel holder or steel rod 10 of a substantial size having an upper end 12 adapted for being received in the chuck of an impact motor or jack hammer. The lower end 14 of holder 10 forms the working end thereof and, in FIGS. 1 and 2, tapers inwardly toward the bottom and terminates in a flat lower end 16.

Adjacent flat lower end 16, body 10 tapers out along a conical region 18 at a larger included angle and between region 18 and the cylindrical portion of holder 10 there is an axial tapered region 20 tapering at a smaller included angle.

A plurality of hard wear resistant elements 22, which may consist of a cemented hard metal carbide such as cemented tungsten carbide, are imbedded in bores 24 provided therefor in holder 10 and in distributed relation in the working end of the bit. The inserts include a group of inserts at 26 imbedded in the flat lower end 16 of the holder and which may protrude axially therefrom. The inserts 22 may have flat outer ends or may be slightly convex as shown in the drawings.

Advantageously, there are a greater number of inserts in axial region 18 than in axial region 20 of the working end of the holder. It will be appreciated that the steel of holder 10 is not substantially weakened at the working end of the tool and the tool can, therefore, be used for prying purposes during the operation of breaking up a formation.

Figure 3:
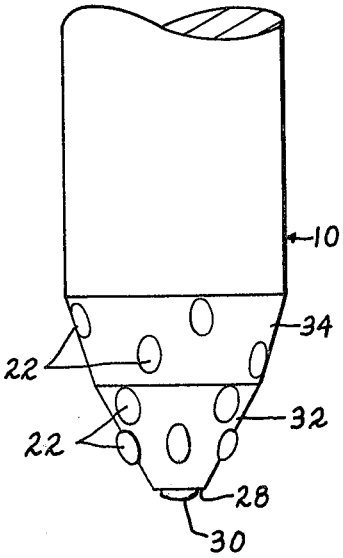
FIGS. 3 and 4 are side and bottom plan views, respectively, of a modified form of the tool.
Figure 4:
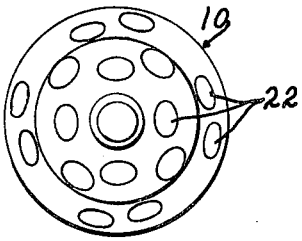
Figure 6:
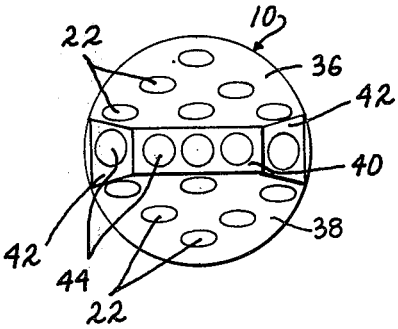

FIGS. 3 and 4 show a tool similar to that illustrated in FIGS. 1 and 2 with the holder 10 tapering inwardly toward the lower end, and which lower end includes a small circular flat area 28 in which a single insert 30 is mounted. The tapered lower end of the tool of FIGS. 3 and 4 has a wider angle region 32 at the bottom and a smaller angle region 34 at the top and the wear resistant inserts 22 are distributed therein in about the same manner as described in connection with FIGS. 1 and 2 except that a greater number are supplied to the smaller angle region 34.

Figure 5:
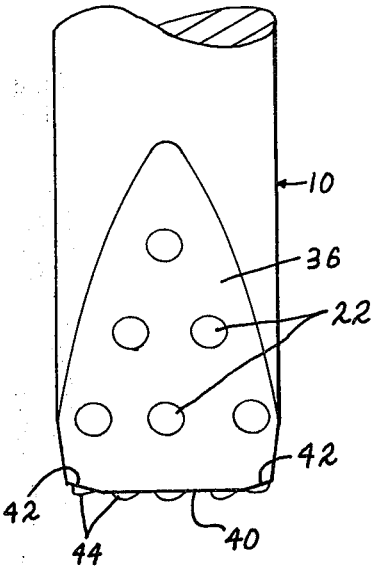
FIGS. 5 and 6 are side and bottom plan views, respectively, of still another form of the tool according to the present invention.

In FIG. 5, the lower end of holder 10 is wedge-shaped and has two flank portions 36 and 38 which taper inwardly toward the bottom of the tool while disposed therebetween at the extreme bottom of the tool is a flat surface 40 having upturned side edges at 42. The flat lower end of the tool of FIG. 5, including the upturned side edges, has inserts 44 imbedded therein, while the flanks 36 and 38 of the tool have inserts 22 imbedded therein.

As mentioned, the inserts may be press fitted into the bores provided therefor or may be brazed in the bores, and in either case, are fixedly connected to the steel rod-like holder.

In each of the modifications, it will be apparent that the strength of the steel is maintained completely to the lower working end of the tool so that the tool is not only useful for impacting but can, also, be used for prying purposes during an impacting operation.

It will also be noted that, in every case, there is at least one hard wear resistant insert on the axially lower end of the tool for contacting the formation to be broken up.

Modifications may be made within the scope of the appended claims.

What is claimed is:

1. An impact or demolition tool comprising; a steel rod having a working portion at one end and a portion at the other end adapted for being gripped by a driver, said working portion tapering inwardly on opposite sides toward the outer end to form a wedge, and a flat outer end at the small end of said wedge, and a plurality of hard wear resistant inserts extending into said working portion in spaced distributed relation and having the outer ends disposed for engagement with work being impacted by the tool.

2. An impact or demolition tool according to claim 1 in which the outer ends of said flat end are inclined rearwardly from the plane of the outer end, and inserts in said rearwardly inclined outer ends.

3. An impact or demolition tool according to claim 1 in which said inserts comprise cemented hard metal carbide material.

4. An impact or demolition tool according to claim 1 in which said inserts are press fitted into bores provided therefor in said tool.

5. An impact or demolition tool according to claim 1 in which said inserts are brazed into bores provided therefor in said tool.

* * * * *